US005713418A

United States Patent [19]

Warren et al.

[11] Patent Number: 5,713,418

[45] Date of Patent: Feb. 3, 1998

[54] VIBRATORY COMPACTOR

[75] Inventors: Robert D. Warren, Pittsboro; Aaron L. Warren, Lizton, both of Ind.

[73] Assignee: Warren Power Attachments, Pittsboro, Ind.

[21] Appl. No.: 684,289

[22] Filed: Jul. 18, 1996

[51] Int. Cl.[6] ..... A01B 35/18

[52] U.S. Cl. ..... 172/40; 37/142.5; 404/117; 404/133.05

[58] Field of Search ..... 37/142.5, 403, 37/903, 904; 172/40, 272, 273, 199; 404/133.05, 133.2, 117

[56] References Cited

U.S. PATENT DOCUMENTS

| | | | |
|---|---|---|---|
| 3,635,133 | 1/1972 | Stougaard | 404/133.2 |
| 3,909,149 | 9/1975 | Century | 404/133.2 |
| 4,098,344 | 7/1978 | Johnson | 172/40 |
| 4,462,172 | 7/1984 | Caron | 37/403 X |
| 4,867,606 | 9/1989 | Wright | 404/133.2 X |
| 4,892,155 | 1/1990 | Wanamaker | 172/199 |
| 5,060,463 | 10/1991 | Jones | 172/273 X |
| 5,403,144 | 4/1995 | Staben, Jr. | 172/272 X |
| 5,526,590 | 6/1996 | Palm et al. | 37/142.5 |

*Primary Examiner*—Terry Lee Melius
*Assistant Examiner*—Robert Pezzuto
*Attorney, Agent, or Firm*—Locke Reynolds

[57] ABSTRACT

Vibratory compactors which are intended to be attached to mobile vehicles, such as a forklift truck, skid steer loader, front end loader, or the like. The vibratory compactors are capable of compacting or tamping soil, and/or other materials suitable for compacting or tamping, over extensive areas. The vibratory compactors can tilt in the pitch and roll directions, and the amount of tilt in the pitch and roll directions can be confined.

15 Claims, 5 Drawing Sheets

VIBRATORY COMPACTOR

BACKGROUND OF THE INVENTION

The present invention relates generally to improved vibratory compactors, as might be particularly useful for tamping or compacting soil. For purposes of the present invention, the term "soil" is meant to generally encompass an assortment of materials that require compacting, including but not limited to, asphalt, coarse gravel and aggregate, dirt, earth, sand and other materials of any quality that may need to undergo a compacting or tamping operation.

The prior art describes various vibratory compactors which utilize a motor for rotating a shaft which drives paired eccentric weights to vibrate a plate that is intended to contact soil or other material to be compacted. Typically, vibratory compactors are used to compact soil and/or other materials preparatory to a subsequent operation, for example, where a layer of asphalt or cement is then applied such as in road construction, or in the construction of poured concrete slabs which form a foundation or floor of a building or the like.

By way of example, in U.S. Pat. No. 2,951,427, Moir discloses a road working machine that employs a plurality of shoes which oscillate vertically relative to the ground. According to Moir, each shoe is supported by a pair of arms which are pivotally mounted on a vehicle. The road working machine described by Moir is excessively complicated by virtue of the plurality of shoes. For example, the plurality of shoes acting in concert creates a stair step configuration during operation which does not accommodate roll tilting. The road working machine described by Moir also suffers because it does not properly control or limit the amount of pitch tilt that the machine undergoes during operation. Because the amount of tilt is not adequately controlled, materials being compacted can get caught under the oscillating shoes as the shoes tilt beyond a certain point, the compacting materials will undesirably slide, and consequently, will preclude or impede the compacting function.

In U.S. Pat. No. 4,224,003,St. Louis discloses a relatively small compactor intended to be mounted to a backhoe boom. The vibrating compactor of St. Louis is not compatible for use with a movable vehicle connected to an articulated front member, such as a forklift truck, skid steer loader, front end loader, or the like. As a result, the compactor described by St. Louis is unable to compact over expansive areas, and operations which require significant power are rendered difficult, if not impossible. In addition, the compactor described by St. Louis does not accommodate roll tilting, nor does it adequately control the amount of pitch tilt accessible to the compactor during use.

Despite the availability of such devices, it will be appreciated from the foregoing that there exists a need in the art for a compactor which is easily compatible for use with a mobile vehicle connected to an articulated front member, such as a front end loader, forklift truck, skid steer loader or the like. There also exists a need for a compactor which is capable of tilting both in the pitch and the roll directions. There is a further need for a compactor which can suitably control the amount of pitch tilt and roll tilt that the compactor bears during operation.

SUMMARY OF THE INVENTION

The aforesaid problems are solved, in accordance with the present invention, by a vibratory compactor which is easily compatible with a mobile vehicle. The vibratory compactor of the present invention can be fixed to any of a variety of motor vehicles. By way of example, the motor vehicle can be in the form of a forklift truck, skid steer loader, front end loader or other type of vehicle.

The vibratory compactor comprises a vibratory plate having a bottom surface that is intended to selectively compact or tamp soil and/or related materials. Selective vibration of the vibratory plate can be actuated by any of a variety of means. For example, a hydraulically powered motor can be employed to rotate a shaft which drives paired eccentric weights to vibrate the vibratory plate as desired. However, other vibration units which can effectuate vibration of the vibratory plate are also encompassed under the present invention.

In accordance with the present invention, the vibratory compactor comprises at least one supporting member. The supporting member has a proximal end which is fixed to a front articulated coupling plate, which, in turn, is connected to a particular motor vehicle. The supporting member also comprises a distal end which projects forward a sufficient distance from the proximal end so as to be positioned substantially above the vibratory plate. Preferably, the supporting member comprises a singular proximal end, with a pair of distal ends projecting forward. Roll pivot means is provided to enable the vibratory compactor to tilt in the roll direction relative to the mobile vehicle. Preferably, a pair of roll tilt limiting means is provided, one at each respective side edge of a supporting member proximal portion. The amount of roll tilt can be limited by the roll tilt limiting means to a pre-defined range.

The distal end of the supporting member is coupled to at least one yoke by coupling means, for example a pin or bolt. Each distal end of the supporting member is coupled to a yoke along a single pitch axis. Preferably, two or more supporting member distal ends are coupled to two corresponding yokes to achieve greater stability. The coupling means coupling the yokes and supporting member distal ends serves as pitch pivot means along the singular pitch pivot axis, thereby enabling the vibratory compactor to tilt in the pitch direction. The amount of pitch tilt is limited by pitch tilt limiting means. Preferably, a pitch tilt limiting means is provided adjacent to each yoke and comprises a slot, for example an arcuate slot, which is capable of receiving a bolt which is provided in a position which is commensurate with a pre-determined pitch tilt range.

The yokes can be coupled to the vibratory plate by upstanding webs through rubber isolator pads. Preferably, each yoke is coupled to an upstanding web through two rubber isolator pads, one forward, and one rear. The isolator pads minimize translation of the vibration from the vibratory plate to other components of the vibratory compactor and the mobile vehicle, thereby permitting more steady compacting. The vibration unit can be mounted on the vibratory plate as well.

Advantageously, the vibratory compactor of the present invention is capable of compacting over expansive areas, for example as encountered in road construction, because it is easily compatible with motor vehicles. Utilizing the vibratory compactor of the present invention with a motor vehicle also provides the benefit of compacting with additional power, thereby enhancing compacting in heavy operations. The vibratory compactor of the present invention facilitates the compacting operation by virtue of its versatility inasmuch as it is capable of tilting both in the roll and pitch directions. The ability of the vibratory compactor to tilt in both the roll and pitch directions is particularly advantageous because the amount of tilt can be sufficiently controlled so as to enable the vibratory compactor to perform with heightened proficiency by minimizing or averting sliding of the materials being compacted, which would otherwise be detrimental to the compacting function.

The present invention will be more fully understood upon reading the following detailed description of the preferred embodiments in conjunction with the accompanying drawings.

DETAILED DESCRIPTION OF THE PREFERRED EMBODIMENT(S)

The following portion of this specification, taken in conjunction with the drawings, sets forth a preferred embodiment of the present invention. The embodiment of the invention disclosed herein includes the best mode contemplated by the inventors for carrying out the invention in a commercial environment, although it should be understood that various modifications can be accomplished within the parameters of the present invention.

Figure 1:
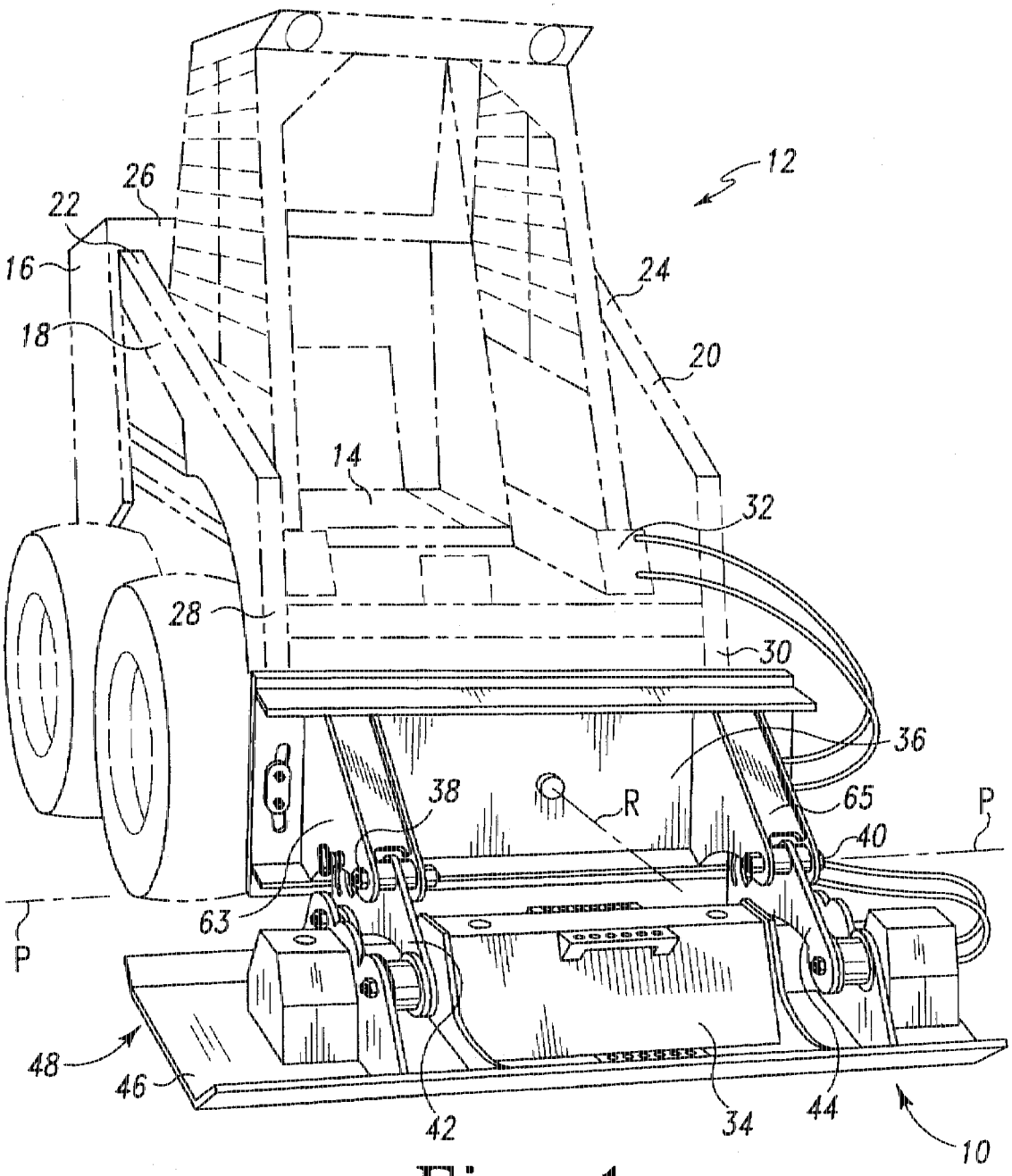
FIG. 1 illustrates a perspective view of the left front of a vibratory compactor, in accordance with the present invention, as combined with a mobile vehicle, shown in phantom.

FIG. 1 generally depicts a vibratory compactor 10 as attached to a mobile vehicle 12, such as a front end loader, in accordance with the present invention. The mobile vehicle 12 is typically power-driven and generally comprises an operating cab 14 from where an operator can selectively manipulate the mobile vehicle 12 and, in turn, the attached vibratory compactor 10, to perform the compacting or tamping task. More specifically, the mobile vehicle 12 comprises a lift frame assembly 16 which can be controlled by an operator while positioned in cab 14. The lift frame assembly 16 comprises a pair of lift arms 18 and 20 which are disposed on either side of the cab 14. The lift arms 18 and 20 have upper ends 22 and 24, respectively, which terminate at a pivotal base 26. The pivotal base 26 extends as a rear portion of frame assembly 16 which is disposed behind cab 14, and which enables each lift arm 18 and 20 to pivot thereto. The lift arms 18 and 20 also have lower ends 28 and 30 which are adapted for connection to the vibratory compactor 10 so as to lift the vibratory compactor 10 or other apparatus such as are disclosed in U.S. Pat. Nos. 4,749,048; 5,098,252; and 5,403,144. The mobile vehicle 12 preferably has a hydraulic power unit 32 which can be utilized to lift the frame assembly 16 as well as direct hydraulic fluid to a vibration unit 34 mounted on vibratory compactor 10, as described in more detail hereinbelow.

The vibratory compactor 10 generally comprises a support member assembly 36 which couples the vibratory compactor 10 to the mobile vehicle 12. The support member assembly 36 supports a pair of forwardly projecting portions or arms 63 and 65. Pins 38 and 40 couple the forwardly projecting portions of the support member assembly 36 to yokes 42 and 44. A vibratory plate 46 having a lower surface 48, which is intended to compact materials to be compacted or tamped, underlies and is connected to the yokes 42 and 44. Significantly, the vibratory compactor 10 of the present invention can tilt in a controlled manner both along a pitch axis, designated as P, as well as a roll axis, designated as R, as described in more detail hereinbelow.

Figure 2:
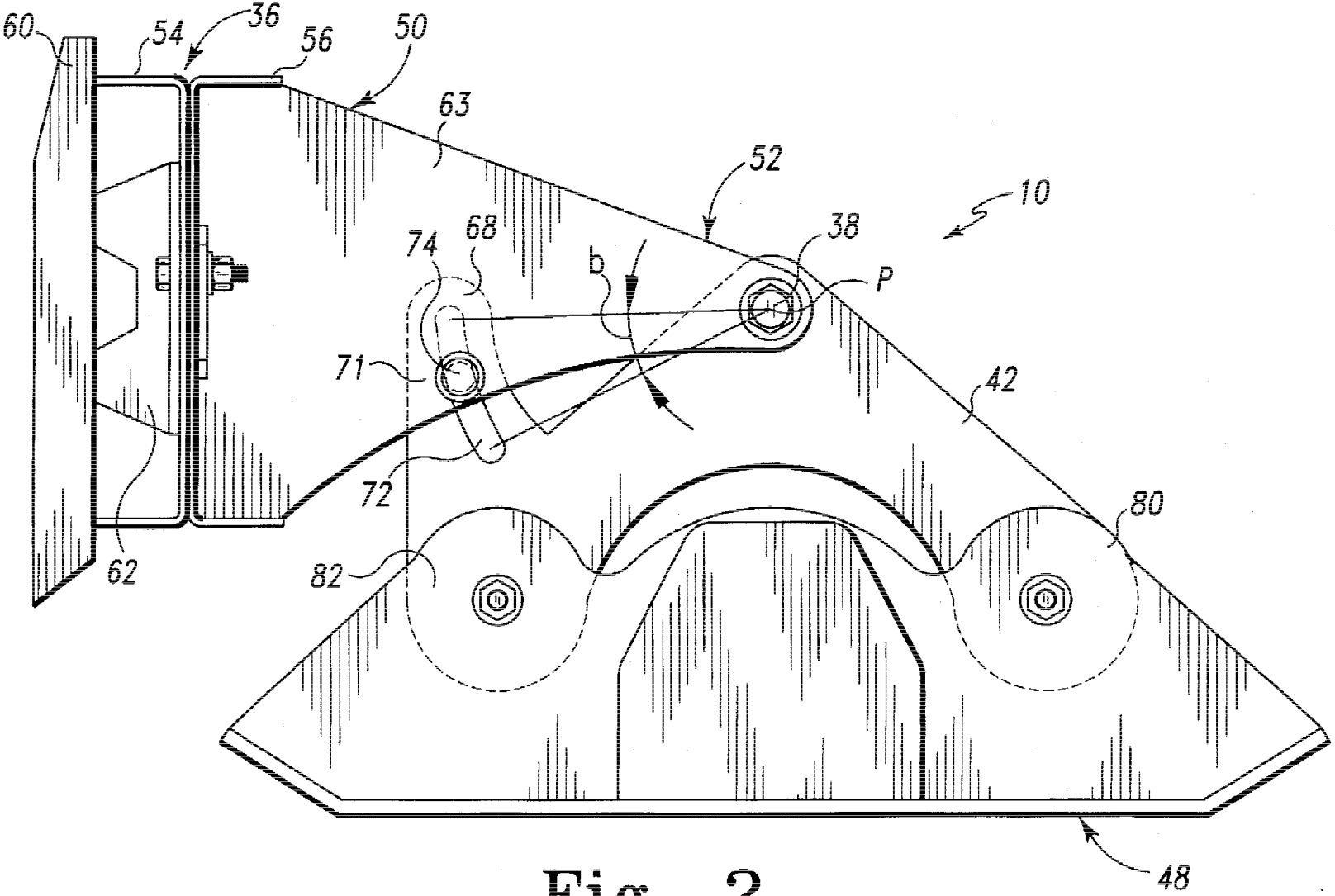
FIG. 2 is a side elevational view showing the vibratory compactor of the present invention.
Figure 3:
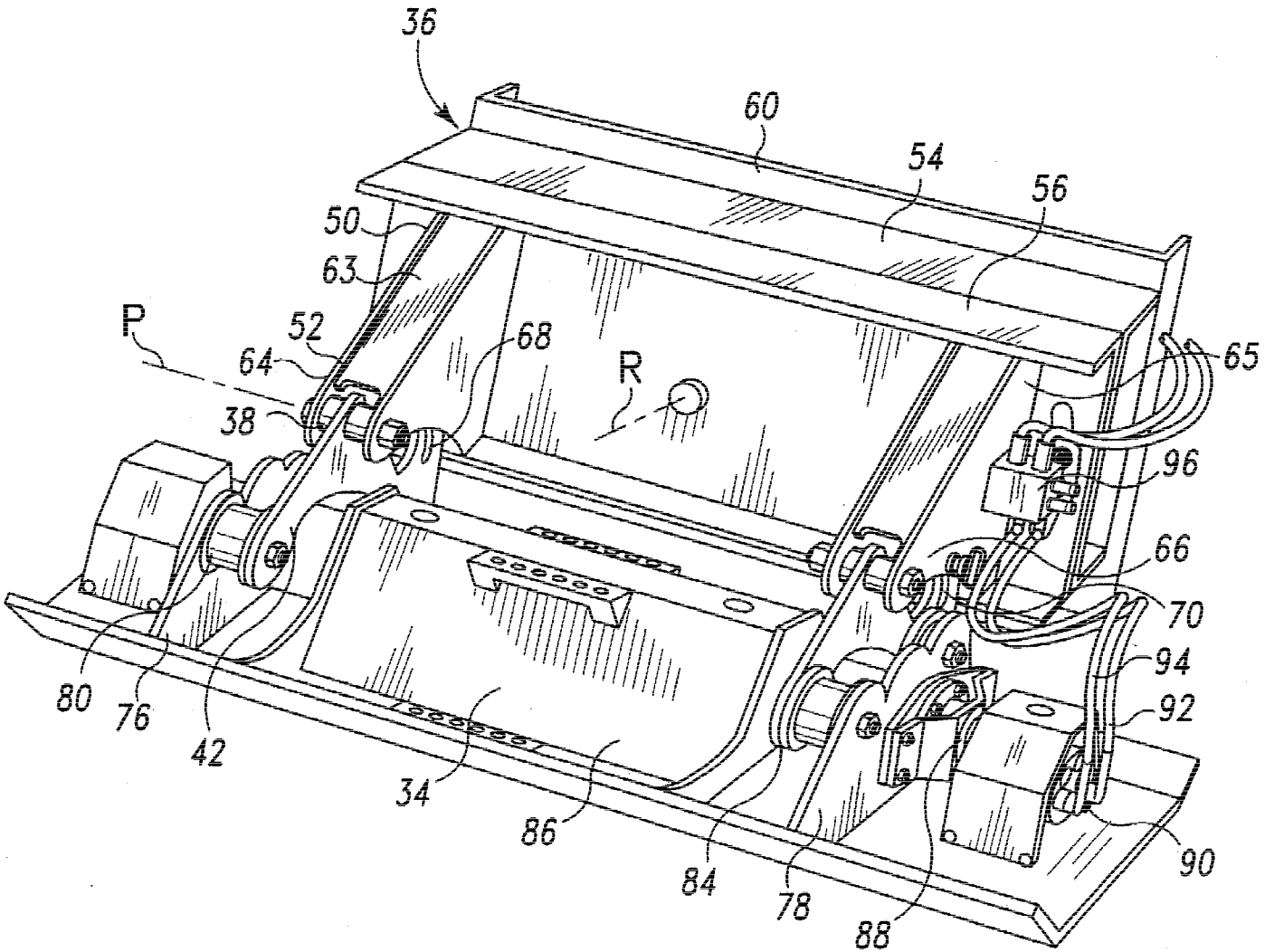
FIG. 3 is a perspective view of the right front of the vibratory compactor, as attached to the coupling plate as shown in FIG. 1.

Referring to FIGS. 2 and 3, the support member assembly 36 comprises a proximal portion 50 including plates 54, 56 and 60, and a distal portion 52 including the arms 63 and 65. The proximal portion 50 comprises of opposed inward facing and outward facing plates 54 and 56, respectively, which are pivotally connected by pivot member 58. Inward plate 54 is also attached, for example by welding, to a coupling plate 60 which, in turn, is adapted to be connected to the motor vehicle 12, in a manner well known from the prior art and as generally described below. At least one set off member 62 can be disposed intermediate to inward plate 54 and coupling plate 60 to enhance structural stability when the vibratory compactor 10 and the mobile vehicle 12 are combined.

The distal portion 52 comprises a pair of forwardly projecting arms 63 and 65 having distal ends 64 and 66, respectively. The forwardly projecting arms 63 and 65 include proximal ends which are fixed to and supported by the outwardly facing plate 54. The forwardly projecting arms 63 and 65 preferably project forward from plate 54 by a distance sufficient to be positioned substantially above the longitudinal center of the vibrating plate 46. More specifically, the arms 63 and 65 project substantially perpendicularly to outward facing plate 56 in a forward or distal direction relative to articulated coupling plate 60. Each distal end 64 and 66 is pivotally connected to a corresponding yoke 42 and 44 by pitch pivot means 38 and 40 in the form of pins. Preferably, the two pitch pivot pins 38 and 40 which couple yokes 42 and 44 to distal ends 64 and 66 are aligned along a singular axis, P. While the illustrated embodiment employs a pair of arms 63 and 65 projecting substantially perpendicularly from outward facing plate 56, the number of arms is a matter of design choice so long as the pitch pivot means connecting the distal ends of the arms to the yokes define a common pitch pivot axis, P.

Each yoke 42 and 44 is provided with pitch tilt limiting means 68 and 70, which are substantially identical in construction to each other. Each pitch tilt limiting means 68 and 70 comprises an upwardly projecting web 71 which includes an arcuate slot 72. Bolts 74 pass through holes provided in the arms 63 and 65 to engage the slot 72 in the contiguous yoke 42 and 44, respectively. The holes in the arms 63 and 65 are positioned accordingly so as to stop the compactor vibratory plate 46 from tilting beyond a pre-determined range. In this manner, the pitch tilt limiting means 68 and 70 limit the amount of pitch tilt that the compactor will experience during operation. As best seen in FIG. 2, bolt 74 of pitch tilt limiting means 68 is positioned in arcuate slot 72 relative to pitch pivot pins 38 so as to define an angle, denoted as "b", which represents the confined angle of pitch tilt permitted by coupling pivot pins 38. Preferably, the angle "b" is an acute angle of less than about 30°, and most preferably, an angle ranging from about 10° to about 20°.

Each yoke 42 and 44 is coupled to the vibratory plate 46 through plate coupling means in the form of one of a pair of upstanding webs 76 and 78 through rubber isolator pads 80 and 82. The rubber isolator pads 80 and 82 isolate the vibration stemming from the vibratory plate 46 by attenuating and thus inhibiting the vibration from being translated through the yokes to the support member assembly 36 and to motor vehicle 12. While each yoke 42 and 44 is provided with two rubber isolator pads 80 and 82, one forward 80 and one rear 82, the number and size of the pads are subject to design variation.

Vibratory plate 46 can be selectively vibrated by means of any suitable vibration unit 34. For example, one of ordinary skill in the art will appreciate that the vibratory plate 46 can be selectively vibrated by a vibration unit 34 which comprises a set of weights (not shown) encased in a housing 86 and which are eccentrically situated with respect to a shaft 88, as best seen in FIG. 3. Shaft 88 can be rotated, for example, by a hydraulically powered motor 90 which causes vibratory plate 46 to vibrate. The hydraulic motor 90 is connected to input hose 92 and return hose 94 for transporting fluid to and from hydraulic motor 90, respectively. Hoses 92 and 94 also communicate with a hydraulic relief valve 96 for absorbing any elevated hydraulic pressure which may result from reversal of the flow through hoses 92 and 94 which occurs when the vehicle 12 changes from a forward to a reverse direction. Input hose 92 and return hose 94 also extend from the hydraulic relief valve 96 to hydraulic power source 32, which is conveniently mounted on the mobile vehicle 12. The relief valve 96 is provided quick disconnects to permit easy disconnection of the hoses 92 and 94 from the mobile vehicle 12 to permit dismounting of the vibratory compactor 10 from the mobile vehicle 12. As noted above, however, the vibratory compactor 10 of the present invention can be caused to be vibrated from any of a variety of sources.

Figure 4:
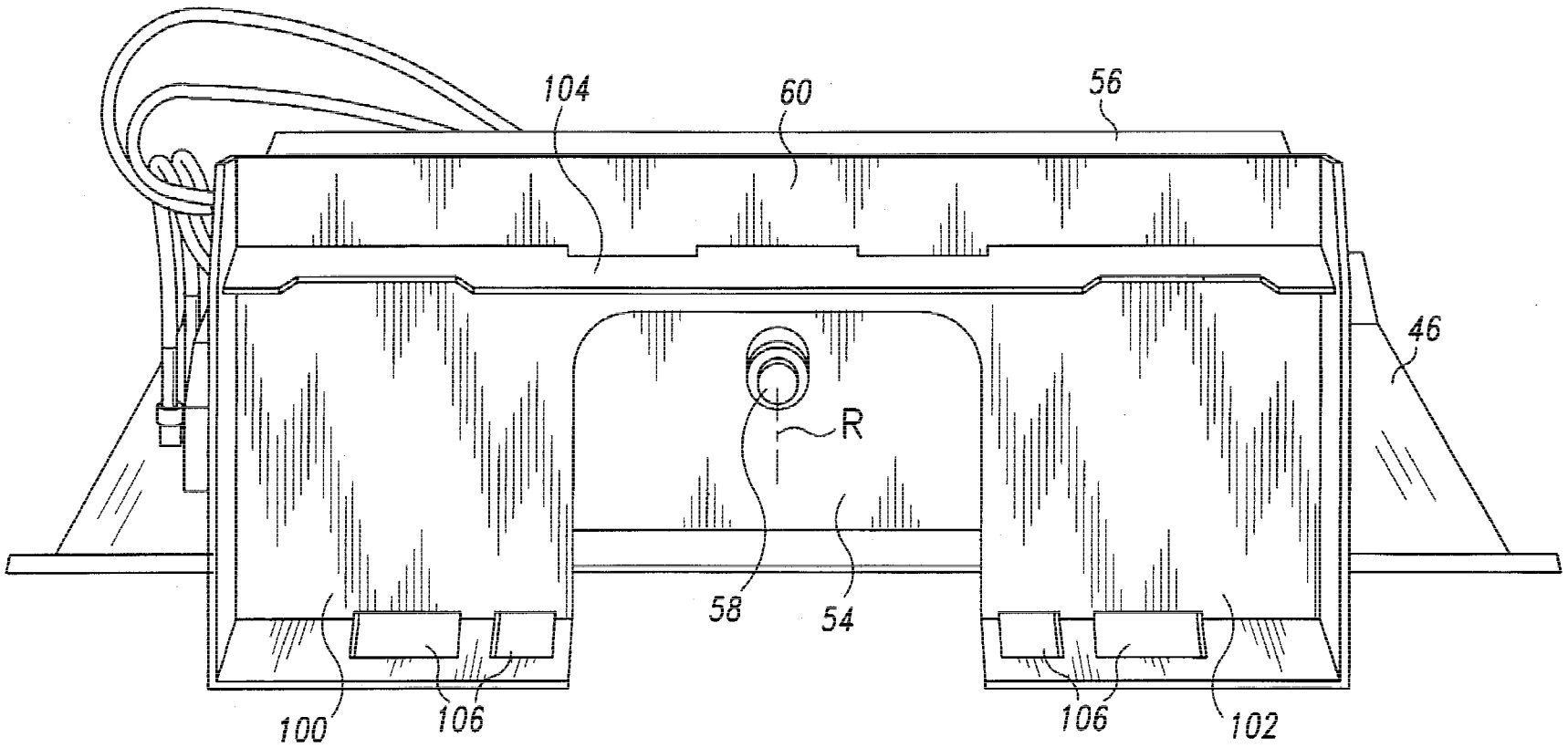
FIG. 4 illustrates a back perspective view of the vibratory compactor of FIG. 1 including a coupling plate which is used to attach a mobile vehicle to the vibratory compactor of the present invention.
Figure 5:
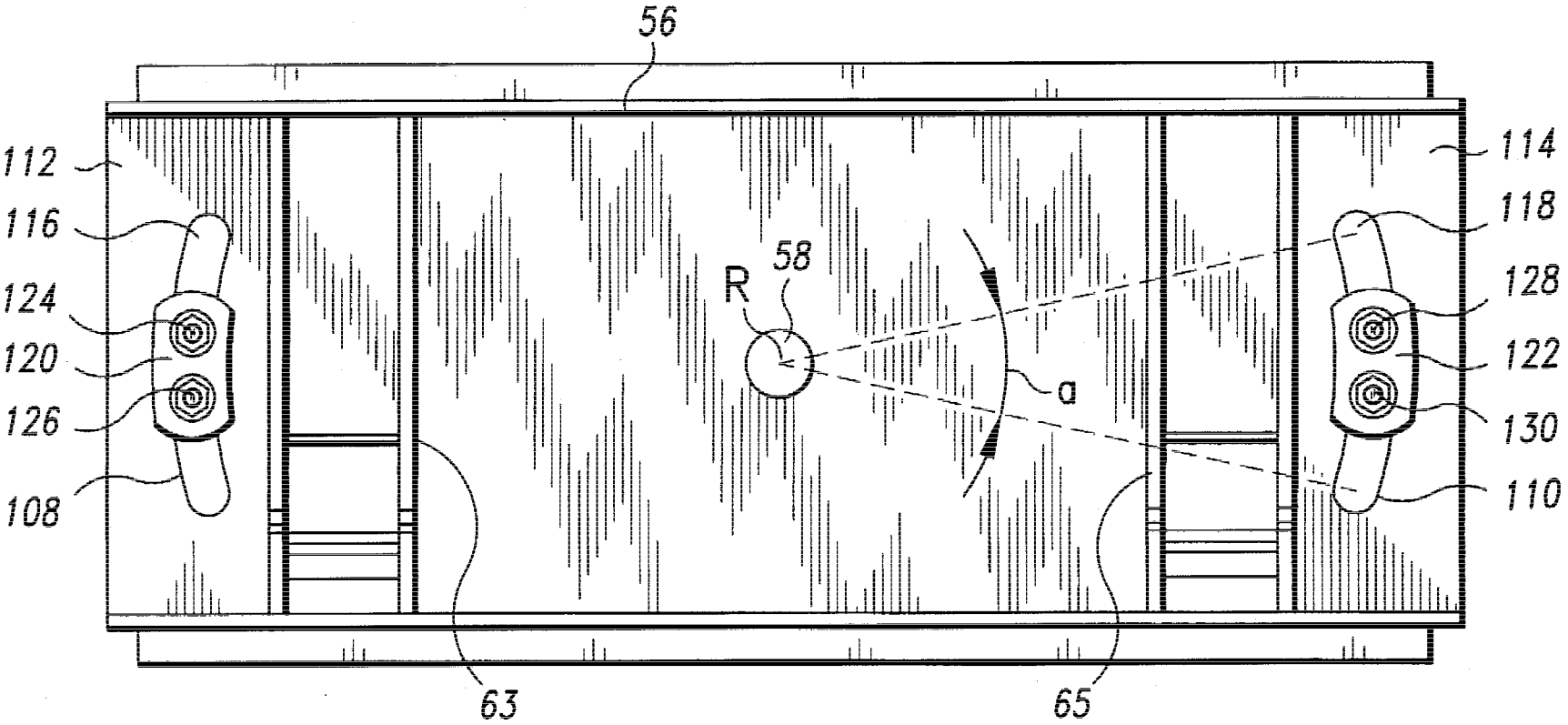
FIG. 5 is a front elevational view of the support member shown in FIG. 4 with the vibratory compactor removed for clarity.

The mounting of the vibratory compactor 10 to the mobile vehicle 12 is achieved through the support member assembly 36 which is illustrated in more detail in FIGS. 4 and 5. FIG. 4 shows the coupling plate 60 which confronts the lower ends 28 and 30 of the lift arms 18 and 20 for coupling the vibratory compactor 10 to the mobile vehicle 12. The coupling plate 60 is configured as a generally planar plate having a curved interior edge 98 which defines an opening at a centrally lower position of the coupling plate 60, thereby defining lateral portions 100 and 102. A backwardly inclined support cross bar 104 extends laterally near an upper portion of the coupling plate 60. The coupling plate 60 also includes one or more apertures 106, which are preferably disposed at a lower end of peripheral lateral portions 100 and 102 of the coupling plate 60. The apertures 106 can be utilized to connect the coupling plate 60 to the lift arm lower ends 28 and 30 of the mobile vehicle 12 in a known manner similar to that shown in U.S. Pat. Nos. 4,749,048; 5,098,252; and 5,403,144. Accordingly, as an operator hydraulically lifts the lift frame assembly 16, while situated in operator cab 14, the vibratory compactor 10 can be moved in concert with the lift frame assembly 16 by virtue of the engagement between the lift arm lower ends 28 and 30 and coupling plate 60.

The coupling plate 60 is fixed to inward facing plate 54 which is, in turn, coupled to outward facing plate 56 by pivot member 58, best shown in FIG. 5. The pivot member 58 is provided in a manner which enables the outward facing plate 56 and the inward facing plate to pivotally tilt relative to each other along the roll axis R. The amount of roll tilt that occurs along the roll axis R is controlled by at least one, and preferably two, roll tilt control means 108 and 110. The roll tilt control means 108 and 110 are provided near each side edge 112 and 114, respectively, of outward facing plate 56. The roll tilt control means 108 and 110 comprise a pair of generally opposed arcuate slots 116 and 118, respectively. Each of the opposed arcuate slots 116 and 118 receives a roll control plate 120 and 122, respectively, which are secured by at least one bolt 124, 126, 128, and 130, respectively (two are shown on each roll control plate 120 and 122). Preferably, each roll tilt control means 108 and 110 is disposed generally equidistant laterally from the pivot member 58. The roll tilt control means 108 and 110 can be dimensioned so as to define a roll tilt angle, denoted as "a", which represents the confined angle of roll tilt permitted along roll axis R. Preferably, the angle "a" is an acute angle of less than about 30°, and most preferably an angle ranging from about 10° to about 20°.

While the preferred embodiment of the invention has been disclosed, it should be appreciated that the invention is susceptible of modification without departing from the spirit of the invention or the scope of the subjoined claims.

What is claimed is:

1. A compactor which is adapted to be coupled to a mobile device, the compactor for compacting an area that is subject to a soil compacting operation, the compactor comprising:

a plate capable of vibrating having a lower surface intended to contact the soil selected in the soil compacting operation;

a vibration unit fixed to the plate for vibrating the plate; a pair of spaced-apart yokes, each yoke having a first end and a second end;

a pair of spaced-apart coupling means for coupling the first end of each of the yokes to the plate;

at least one supporting member having a proximal end and a pair of spaced-apart generally triangular plate members, each plate member including a projecting distal end, the distal ends being positioned substantially above the plate;

a pair of spaced-apart pitch pivot means for defining a pitch axis, the pitch pivot means connecting the second ends of the yokes to the plate member distal ends, wherein the pitch pivot means permits the plate to tilt along the pitch axis;

pitch limiting means for limiting the amount of pitch tilt allowed by the pitch pivot means to a pre-defined range; and roll pivot means included in the supporting member for defining a roll axis which is substantially perpendicular to the pitch axis.

2. A compactor as defined in claim 1 further comprising roll limiting means for limiting the amount of roll tilt allowed by the roll pivot means.

3. A compactor as defined in claim 2 wherein the roll limiting means limits the amount of roll tilt allowed by the roll pivot means to a pre-defined range.

4. A compactor as defined in claim 3 wherein the pitch limiting means comprises a slot which is adapted to receive a bolt.

5. A compactor as defined in claim 4 wherein each of said coupling means comprises rubber isolator pads disposed intermediate the first end of one of the yokes and the plate for vibrationally isolating the plate from said yokes.

6. A compactor as defined in claim 5, further comprising a housing disposed generally between the pair of coupling means for covering at least a portion of the vibration unit.

7. A compactor for compacting an area that is subject to a soil compacting operation comprising:

a vibrating plate to compact an area of soil;

at least one support member having a proximal end, and a pair of spaced-apart generally triangular plate members, each plate member including a distal end projecting forward by a distance sufficient to be positioned substantially above said vibrating plate, the support member including mobile device coupling means for coupling the support member proximal end to a mobile device including roll pivot means defining a roll axis for permitting the support member to pivot relative to the mobile device along the roll axis;

a pair of spaced-apart yokes, each yoke having a first end and a second end;

a pair of spaced-part plate coupling means for coupling the first end of each of the pair of yokes to said vibrating plate;

a pair of spaced-apart pitch pivot means for defining a pitch axis which is substantially perpendicular to the roll axis, each of the pitch pivot means connecting the second end of one of the yokes to the distal end of one of the plate members, wherein the pitch pivot means permit the vibrating plate to be tiltable along the pitch axis; and at least one pitch limiting means disposed adjacent to the first end of at least one of the yokes for controlling the amount of pitch tilt allowed by the pitch pivot means.

8. A compactor as defined in claim 7 further comprising roll limiting means for limiting the amount of tiltability of the support member relative to the mobile device.

9. A compactor as defined in claim 8 wherein the roll limiting means limits the amount of tiltability of the support member relative to the mobile device to a pre-determined range.

10. A compactor as defined in claim 7 wherein the pitch limiting means limits the amount of pitch tilt allowed by the pitch pivot means to a predefined range.

11. A compactor as defined in claim 7 wherein the pitch limiting means comprises a slot which is adapted to receive a bolt.

12. A compactor as defined in claim 7 wherein each of said plate coupling means comprises rubber isolator pads disposed intermediate the first end of one of the yokes and the vibrating plate for vibrationally isolating the vibrating plate from said yokes.

13. A compactor as defined in claim 7 wherein the proximal end of said support member comprises inwardly and outwardly facing plates coupled by the roll pivot means and a coupling plate fixed to the inwardly facing plate and to said mobile vehicle.

14. A compactor as defined in claim 7, further comprising a housing disposed generally between the pair of plate coupling means for covering at least a portion of the vibrating plate.

15. A compactor for compacting an area that is subject to a soil compacting operation comprising:

a vibrating plate to compact an area of soil;

a support member having a proximal end, and a pair of spaced-apart generally triangular plate members, each plate member including a distal end projecting forward by a distance sufficient to be positioned substantially above said vibrating plate, the support member having mobile device coupling means for coupling the support member proximal end to a mobile device including roll pivot means defining a roll axis for permitting the support member to pivot relative to the mobile device along the roll axis, the proximal end of said support member including inwardly and outwardly facing plates coupled by the roll pivot means and a coupling plate fixed to the inwardly facing plate and to said mobile vehicle;

a pair of spaced-apart yokes, each yoke having a first end and a second end;

a pair of spaced-apart plate coupling means for coupling the first end of each of the pair of yokes to said vibrating plate, each of said plate coupling means including rubber isolator pads disposed intermediate the first end of one of the yokes and the vibrating plate for vibrationally isolating the vibrating plate from said yokes;

a housing disposed generally between the pair of plate coupling means for covering at least a portion of the vibrating plate;

a pair of spaced-apart pitch pivot means for defining a pitch axis which is substantially perpendicular to the roll axis, each of the pitch pivot means connecting the second end of one of the yokes to the distal end of at least one of the plate members, wherein the pitch pivot means permit the vibrating plate to be tiltable along the pitch axis;

at least one pitch limiting means disposed adjacent to the first end of at least one of the yokes for controlling the amount of pitch tilt allowed by the pitch pivot means to a predefined range, including a slot which is adapted to receive a bolt; and a roll limiting means for limiting the amount of tiltability of the support member relative to the mobile device to a pre-determined range.

* * * * *